US006520448B1

(12) United States Patent
Doty et al.

(10) Patent No.: US 6,520,448 B1
(45) Date of Patent: Feb. 18, 2003

(54) SPINNING-VEHICLE NAVIGATION USING APPARENT MODULATION OF NAVIGATIONAL SIGNALS

(75) Inventors: James H. Doty, Cedar Rapids, IA (US); Gary A. McGraw, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/879,392

(22) Filed: Jun. 12, 2001

(51) Int. Cl.[7] ..... F42B 10/00; F41G 7/00

(52) U.S. Cl. ..... 244/3.23; 244/3.1; 244/3.15; 244/3.19; 244/3.24; 701/207; 701/213; 342/357.01; 342/357.06; 342/450; 342/451

(58) Field of Search ..... 244/3.1, 3.15, 244/3.19–3.3, 3.16–3.18; 701/207, 213, 214–226; 342/73–81, 357.01–357.17, 450–465

(56) References Cited

U.S. PATENT DOCUMENTS

| | | | | |
|---|---|---|---|---|
| 2,716,893 A | | 9/1955 | Birdsall | |
| 4,457,173 A | | 7/1984 | Hunter | |
| 4,520,669 A | | 6/1985 | Rider | |
| 4,679,748 A | * | 7/1987 | Blomqvist et al. | 244/3.19 |
| 4,967,981 A | * | 11/1990 | Yff | 244/3.21 |
| 4,979,696 A | * | 12/1990 | Yff | 244/3.21 |
| 5,657,947 A | * | 8/1997 | Mayersak | 244/3.19 |
| 6,208,936 B1 | | 3/2000 | Minor et al. | 701/220 |
| 6,069,584 A | * | 5/2000 | Johnson | 244/3.1 |
| 6,163,021 A | | 12/2000 | Mickelson | 244/3.2 |
| 6,237,496 B1 | * | 5/2001 | Abbott | 244/3.19 |
| 6,398,155 B1 | * | 6/2002 | Hepner et al. | 244/3.15 |

OTHER PUBLICATIONS

Grasshoff, L. H. "An Onboard, Closed–Loop, Nutation Control System For Spin–Stabilized Spacecraft," Journal of Spacecraft and Rockets, vol. 5, May 1968, pp. 530–535.

Hemmel, D. L. and Rider, B. F. "A New Sensor Approach To An Attitude/Heading Reference System," SAE document 830759, Business Aircraft Meeting & Exposition, Wichita, KS, Apr. 12–15, 1983.

Kayton, M. and Fried, W. R. *Avionics Navigation Systems*, 2nd Edition, 1997, John Wiley & Sons, Inc. pp. 235–248.

Smay, J. W. and Slafler, L. I. "Dual–Spin Spacecraft Stabilization Using Nuational Feedback And Inertia Coupling," Journal of Spacecraft and Rockets, vol. 13, Nov. 1976, pp. 650–659.

* cited by examiner

*Primary Examiner*—Bernarr E. Gregory
(74) *Attorney, Agent, or Firm*—Nathan O. Jensen; Kyle Eppele

(57) ABSTRACT

Attitude of a spinning vehicle is determined by observing at least one of the apparent amplitude modulation and the apparent phase modulation of a navigation signal received from a navigation source. Vectors describing the direction from the vehicle to the navigation source are computed and used to determine attitude relative to the navigation source. Inertial sensors are demodulated to remove rotation artifacts and used to anticipate rapid maneuvers.

24 Claims, 8 Drawing Sheets

SPINNING-VEHICLE NAVIGATION USING APPARENT MODULATION OF NAVIGATIONAL SIGNALS

BACKGROUND OF THE INVENTION

1. Technical Field

This invention pertains to the field of navigation and guidance of spinning vehicles and/or projectiles.

2. Description of the Prior Art

In many applications, such as artillery shell or missile guidance, the vehicle to be guided is spinning rapidly. Guidance systems integral to such spinning vehicles require significant real-time processing capacity. This is because all of the sensor inputs and guidance actuator controls must be corrected to account for the effects of the spinning body. Neutralizing these unwanted rotational artifacts can only be accomplished if the orientation of the spinning body can also be determined in real-time. Practically speaking, it is difficult to determine the rotational orientation of a spinning body. Gyros have traditionally been used to sense orientation. Use of gyros in these kinds of applications is problematic because the scale-factor errors exhibited by spin-axis gyroscopes result in significant cumulative attitude estimate error.

Other means for determining the attitude of a spinning vehicle have included the use of spinning accelerometers or strain sensors mounted on a spinning wheel. These prior art apparatus provide for the measurement of the vehicle's rotation-rate. Measurements utilizing spinning accelerometers are referred to as Coriolis rate measurements because of sinusoidal Coriolis acceleration artifacts they include. To remove these artifacts, the sensor signals must be demodulated. This normally involves a secondary sensor that indicates the rotational position of the spinning wheel relative to the body of the spinning vehicle. Such secondary rotational orientation sensors might include sun trackers or magnetic field sensors. These types of sensors may not be appropriate for every environment and they may not work well in certain geographic regions when the vehicle is aligned with the earth's magnetic field.

These obstacles have caused known guided-projectile technology to use mechanical de-spinning systems in order to isolate the guidance system from the spinning projectile. These mechanically de-spun projectiles are excessively expensive and notoriously unreliable. The de-spinning mechanism adds unwanted cost, size, and complexity. A cost-effective technique for determining a spinning vehicle's attitude in real time is desirable. Once this type of real-time attitude determination becomes available, it becomes possible to remove rotation artifacts from the guidance system.

SUMMARY OF THE INVENTION

As a vehicle spins during flight, any antenna mounted on the circumference will view signal sources with an apparent modulation of amplitude and phase. This phenomenon can be exploited to determine the attitude of a spinning vehicle relative to navigation source it uses for guidance. Once the attitude can be determined, then guidance control and any secondary sensors can be demodulated to remove rotational artifacts.

In the present invention, a method for determining the trajectory and the attitude of a spinning vehicle is specified. This method comprises the use of an antenna mounted on a spinning vehicle in a manner that enables the antenna to receives a navigation signal from a navigation source. The navigation source can comprise a NAVSTAR Global Positioning System (GPS) satellite, a satellite from a similar satellite navigation system (generically referred to as Global Navigation Satellite System GNSS) such as a Global'naya Navigatsionnaya Sputnikovaya Sistema (GLONASS) satellite, or it may be terrestrially deployed.

The method goes on to comprise a step for tracking the apparent modulation of the navigation signal. Either the amplitude of the signal, the phase of the signal or both the amplitude and phase of the navigation signal are tracked. The navigational signal is decoded in order to extract the position of the vehicle relative to the navigation source. The rotational position relative to the navigation source is then calculated from vectors that define the direction from the spinning vehicle to the navigation source.

The position information extracted from the navigation source is used to establish a trajectory for the spinning vehicle. Additionally, inertial sensors are used to anticipate high-speed maneuvers that could not ordinarily be tracked using the navigation sources alone. The trajectory is conformed to such anticipated variance from the navigational solution. Because the inertial sensors are spinning collectively with the vehicle, they must be demodulated to remove rotational artifacts to that Coriolis and lateral acceleration components can be utilized in the trajectory solution.

Receiving the radio signal comprises the steps of converting the radio frequency to a lower intermediate frequency. The intermediate frequency is digitized so that is can be processed digitally. During signal processing, rotational artifacts are removed from the signal using estimates of rotation rate and attitude. In one variant of the present invention, the rotational artifact is removed by amplifying the signal when the navigation source is in the field of view of the antenna and attenuating the signal when the navigation source is not plainly visible. In one alternative, the signal is tracked using three channels, one for a centered estimate of the roll angle, one for a retarded estimate of the roll angle and one channel for an advanced estimate of the roll angle.

Embodied in an apparatus, the present invention comprises an antenna that receives radio signals and a receiver that accepts the radio signals from the antenna. In operation, the antenna is mounted on a spinning vehicle so that a navigation signal can be received from a navigation source. The receiver selects the navigation signal from amongst all of the signals received by the antenna. The navigational signal can be generated by a GPS satellite, another GNSS satellite or a terrestrial source.

A tracking unit comprises a capability to track amplitude modulation, phase modulation or amplitude and phase modulation that is imparted onto the navigation signal as a result of the rotation of the spinning vehicle. This imparted modulation has also been previously referred to as apparent modulation. The present invention further comprises a decoding unit that extracts position information from the navigation signal and creates successive samples of the vehicles position.

A modulation geometry processor accepts the successive samples of vehicle position from the decoding unit and generates source vectors that define the direction from the spinning vehicle to the navigation source. The present invention further comprises an attitude estimator that calculates the rotational position of the vehicle relative to the navigation source based on the source vectors. The attitude estimator bases the calculated estimate on the amplitude modulation, the phase modulation or the amplitude and the phase modulation imparted onto the navigation signal, i.e. the apparent modulation. The actual position of the vehicle is maintained by a position estimator and is based on position information extracted from the navigation signal by the decoding unit and the source vectors calculated by the modulation geometry processor.

The present invention further comprises a guidance processor that maintains a trajectory for the spinning vehicle that is based on the position information extracted from the navigation signal. The position unit uses inertial sensor inputs to anticipate high-velocity maneuvers thereby conforming the navigation-source based trajectory to the vehicle's actual flight. The sensor inputs are demodulated by an inertial sensor demodulator that removes rotation artifacts by applying the estimated rotation position relative to the navigation source.

The receiver of the present invention comprises a radio frequency (RF) section that converts RF signals into an intermediate frequency (IF). The IF signal is then digitized by a digitizer and routed to a signal processor. The signal processor accepts the digital stream and removes the rotation artifacts from the stream based on estimates of the rotation rate and attitude.

According to the present invention, the signal processor removes rotation artifacts caused by apparent amplitude modulation by amplifying the digital stream when, according to the rotation attitude estimate, the navigation source is in the field of view of the antenna. In a like manner, the digital stream is attenuated when the navigation source is outside the antenna's reception pattern. The tracking unit is in essence a servo that locks into the rotation frequency and phase by using a normal tracking channel augmented by a pair of offset channel, one for advanced and the other for retarded estimates of the rotation angle. Given any difference in the advanced and retarded signal, the estimate of rotation angle is updated by a control loop. All of the estimates are maintained in registers that are used on subsequent iterations of the control loop. Demodulating the apparent phase modulation is accomplished by varying the propagation delay the digital IF stream experience through the signal processor.

The method and apparatus described herein are further employed in a system for delivering spinning vehicles to a destination. This system comprises a navigation source and a spinning vehicle launch system and the spinning vehicle that incorporates the apparatus and method afore described. The navigation source comprises one of either an earth-orbiting satellite, as for instance a GOS or GLONASS satellite, or an earth-bound beacon. Prior to launching the vehicle toward the destination, a probable trajectory is computed and loaded into the vehicle. Based on this probable trajectory, the spinning vehicle can rapidly acquire the navigation source without having to first lock onto the rotation rate or orientation.

BRIEF DESCRIPTION OF THE DRAWINGS

The foregoing aspects are better understood from the following detailed description of one embodiment of the invention with reference to the drawings, in which.

DETAILED DESCRIPTION OF THE INVENTION

Figure 1:
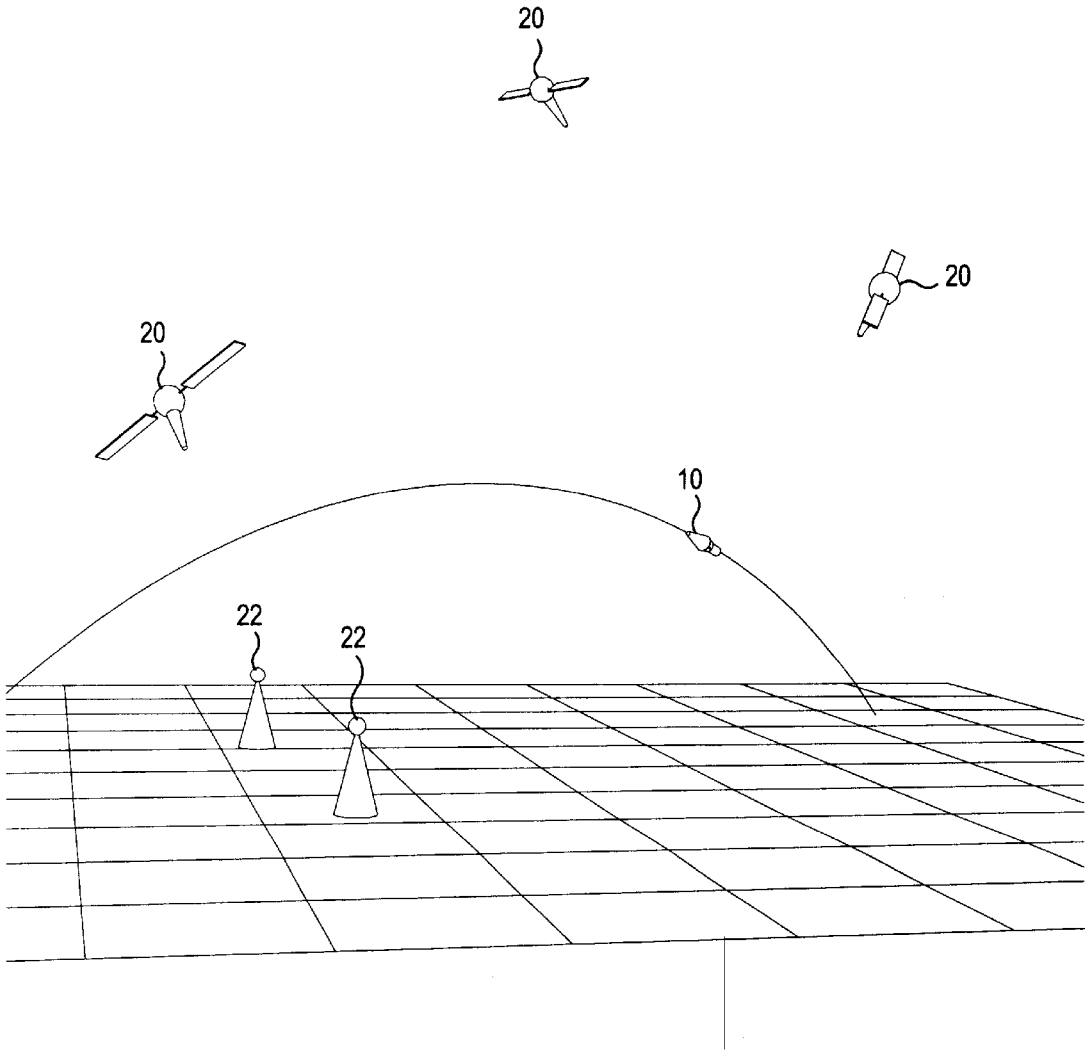
FIG. 1 is a pictorial representation of a system for guiding a spinning vehicle to a destination.

FIG. 1 is a pictorial representation of a system for guiding a spinning vehicle to a destination. In many applications, the system comprises a navigation source that emanates a navigation signal. In most operational scenarios, the navigation source comprises an earth-orbiting satellite 20. The navigation signal reaches the spinning vehicle 10. Spinning vehicle 10 uses the navigation signal to determine its own position in the operational theatre. Additionally, and uniquely to the present invention, spinning vehicle 10 uses the navigation signal to determine the orientation of the spinning vehicle relative to the navigation source, be it a satellite 20 or a terrestrially deployed beacon 22. Note that in some applications, terrestrially deployed beacons 22 are used as additional navigation sources in order to augment satellites 20. This augmentation can be used to improve overall precision of the attitude determination or to ensure higher operational availability for the system overall. During the course of this disclosure, the term navigation source shall be construed to mean any source that generates a navigation signal, be it satellite 20 or beacon 22. Use of this term will be considered analogous to either the term "satellite" or the term "beacon". The reference numeral "20" will also be used to refer to a navigation source as well as to a satellite.

Figure 2:
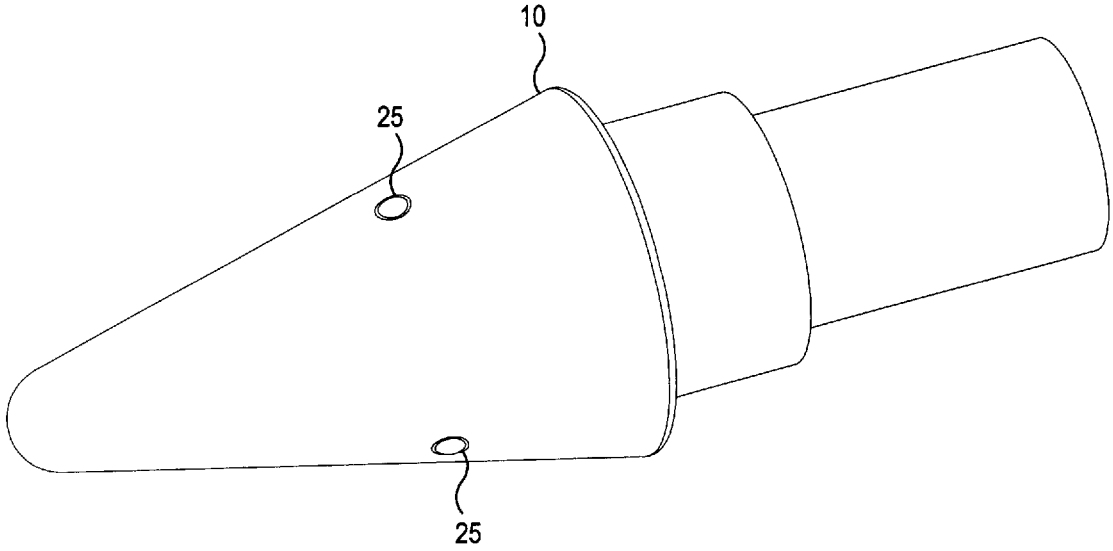
FIG. 2 is a pictorial representation of a spinning vehicle modified in accordance with the present invention.

FIG. 2 is a pictorial representation of a spinning vehicle modified in accordance with the present invention. Spinning vehicle 10 is augmented with at least one antenna 25 for receiving radio signals. The radio signals include, among other signals, the navigation signals generated by navigation source 20. As spinning vehicle 10 spins, it will experience what appears to be a modulation in the amplitude of the navigation signal received from navigation source 20. Also, the navigation signal will apparently be phase modulated because of the spinning.

Figure 3:
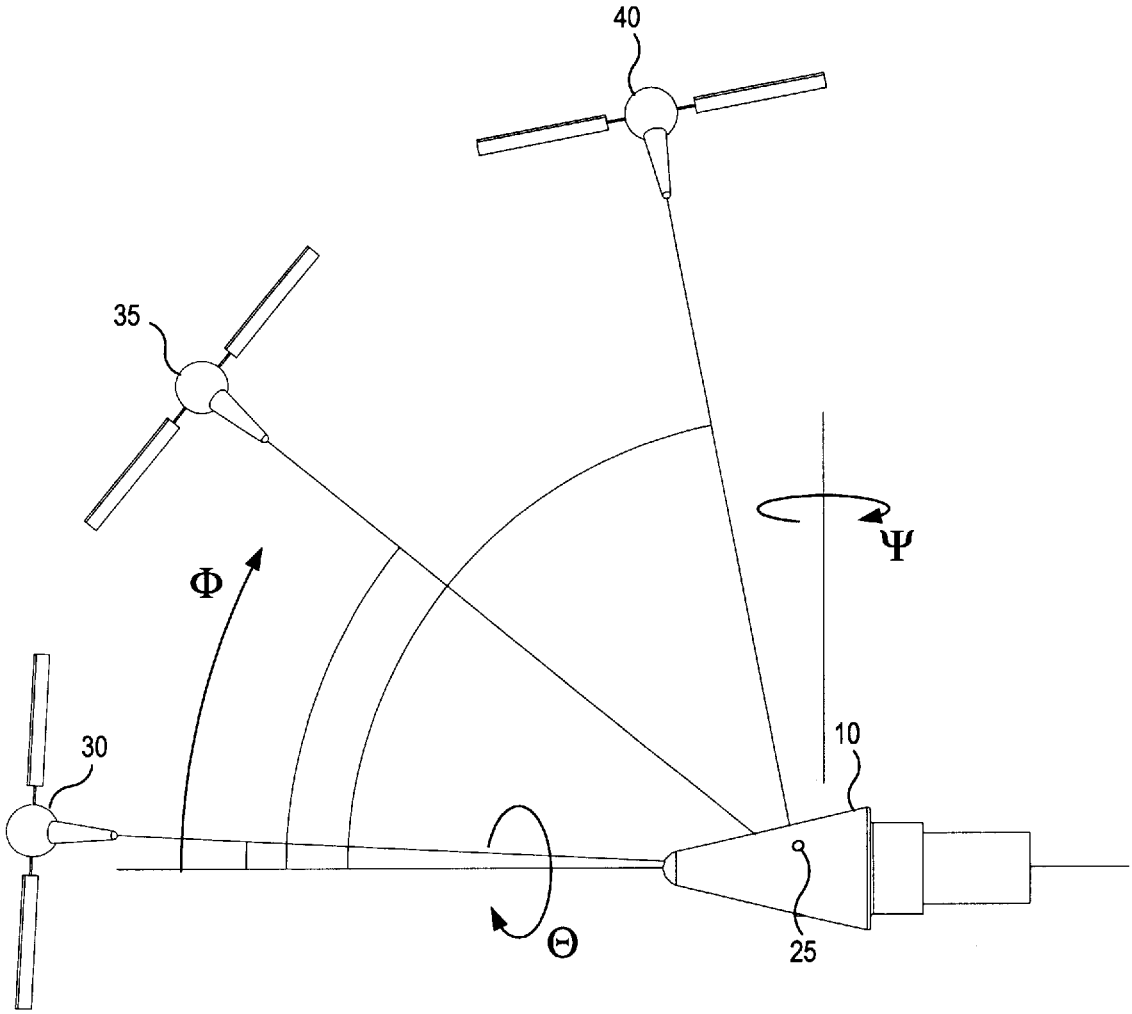
FIG. 3 is a pictorial representation of the mechanism for inducing apparent modulation into the navigation signal.

FIG. 3 is a pictorial representation of the mechanism for inducing apparent modulation into the navigation signal. Considering three separate navigation sources, referred to as 30, 35 and 40, each of these sources is visible to an antenna 25 mounted on spinning vehicle 10. Navigational source 40 can be considered as being directly in the field of view of antenna 25. As vehicle 10 spins, the navigation source comes into and falls out of the antenna's field of view. The amount of apparent modulation is related to the pitch of the vehicle relative to the flight path. The amount of modulation is dependent on a myriad of factors, including but not limited to the design of the antenna and its mounting position on the spinning vehicle. Generally, the modulation level is small along the spin axis, but is greater normal thereto. Pitch is denoted by the variable "Φ". For navigation source 40, the amount of apparent modulation is greater than that induced for navigation source 35. This is due to the fact that the antenna's field of view will perceive a greater signal from those navigation sources at its focal target. Sources visible at the periphery of the field of view will be weaker at the peak and will not exhibit the same degree of excursion in signal strength.

Figure 4:
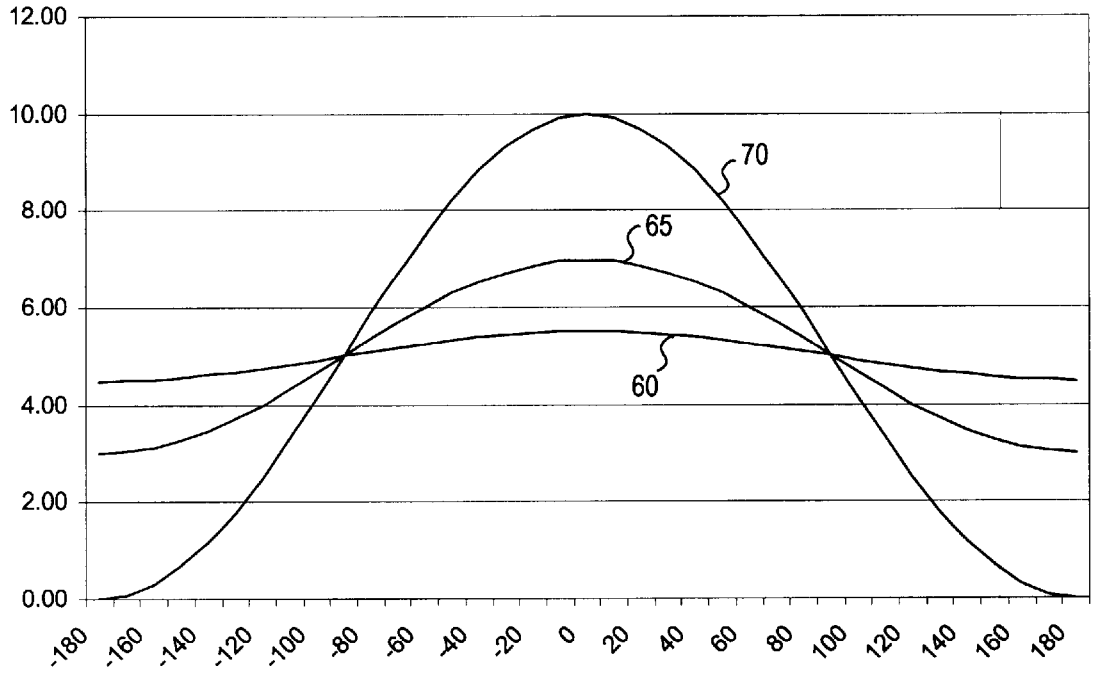
FIG. 4 is a graph that illustrates the relative amounts of apparent modulation perceived by an antenna for varying pitch angles for a spinning vehicle.

FIG. 4 is a graph that illustrates the relative amounts of apparent modulation perceived by an antenna for varying pitch angles for a spinning vehicle. Noting that the first curve 60 represents the pitch angle of navigational source 30, this curve exhibits the least amount of apparent modulation in a navigation signal received by an antenna mounted on a spinning vehicle. Likewise, as the pitch angle increases to that represented by navigation source 35, so does the amount of apparent modulation (curve 65). When the pitch angle corresponds to a configuration where the navigation source is directly in the focal target of the antenna, the amount of apparent modulation will be maximal as depicted by curve 70.

Figure 5:
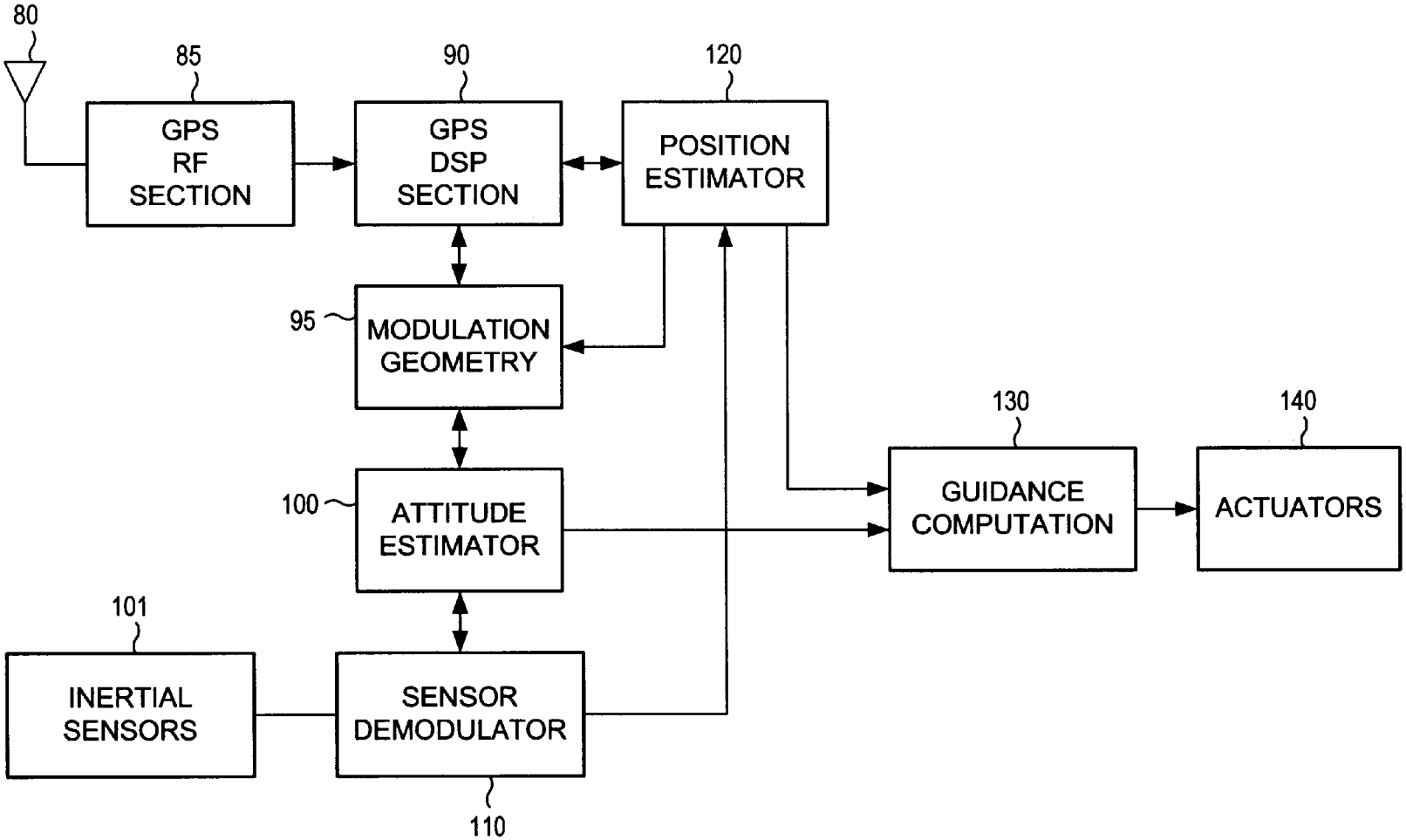
FIG. 5 is a block diagram that depicts the structure of a navigation receiver according to the present invention.

FIG. 5 is a block diagram that depicts the structure of a navigation receiver according to the present invention. Noting that an antenna 80 is actually the antenna that is mounted on the outer shell of a spinning vehicle, it is important to realize that as the vehicle spins the navigation source will appear to be modulated by the spin rate. Antenna 80 receives a spectrum of radio frequency (RF) energy and delivers this to an RF section 85. The RF section is completely compatible with any given navigational source. For instance, if the navigational source is a global positioning system (GPS) satellite, the RF section 85 can be an unmodified GPS RF section. There are no special capabilities required in the RF section 85 to support implementation of the present invention.

GPS RF section 85 converts the high frequency range of GPS signals to a lower frequency range intermediate frequency (IF). The IF signals are then digitized so that the output of GPS RF section 85 is a stream of digital values. A GPS digital signal processor (DSP) 90 receives the stream of digital values representative of the IF signal and performs traditional digital radio demodulation. Demodulated navigation signals are delivered to a position estimator 120. Position estimator 120 extracts position information from the demodulated navigation signals.

A modulation geometry processor 95 receives position information from the position estimator 120. This position information is used to create vectors from the spinning vehicle back to the navigation source. These are called source vectors. Once the source vectors are derived, they are delivered to an attitude estimator 100. Attitude estimator 100 tracks the current orientation of the spinning vehicle relative to the navigation source and also tracks rotation rates about all three axes, roll (spin axis), pitch and yaw.

A sensor demodulator 110 accepts spin rate and attitude information from attitude estimator 100. In the present invention, inertial sensors 101 are mounted about the radius of the spinning vehicle. These are used to anticipate maneuvers that cannot otherwise be tracked by a low bandwidth navigational system. The signals from inertial sensors 101 represent Coriolis rotation rate and lateral acceleration and are modulated by rotational artifacts as the vehicle spins. The rotational artifacts are removed by sensor demodulator 110 by applying the spin rate received from the attitude estimator 100.

Position estimator 120 receives position data from GPS DSP 90 and maintains a track for the spinning vehicle. Position estimator 120 accepts demodulated inertial data from sensor demodulator 110 as roll, pitch and yaw rates. The roll, pitch and yaw rates are used as anticipation factors to ensure that the position track maintained by position estimator 120 conforms to rapid maneuvers that could not otherwise be tracked by a pure navigation signal based tracking means. Use of inertial sensors to enhance position accuracy in a navigation signal based system such as GPS are well known in the art. The novel feature here comprises the use of spin rate tracking, as generated by attitude estimator 100, to remove the rotational artifacts induced by the rotation of the spinning vehicle.

In a particular solution, the output of position estimator 120 is directed to a guidance computer 130. Guidance computer 130 generates commands to one or more actuators 140 so that the trajectory of the spinning vehicle can be controlled. The actuator control algorithms within guidance computer 130 must be cognizant of the rotational position of the spinning vehicle. This information is obtained from attitude estimator 100 in terms of roll, pitch and yaw positions for the vehicle.

Figure 6:
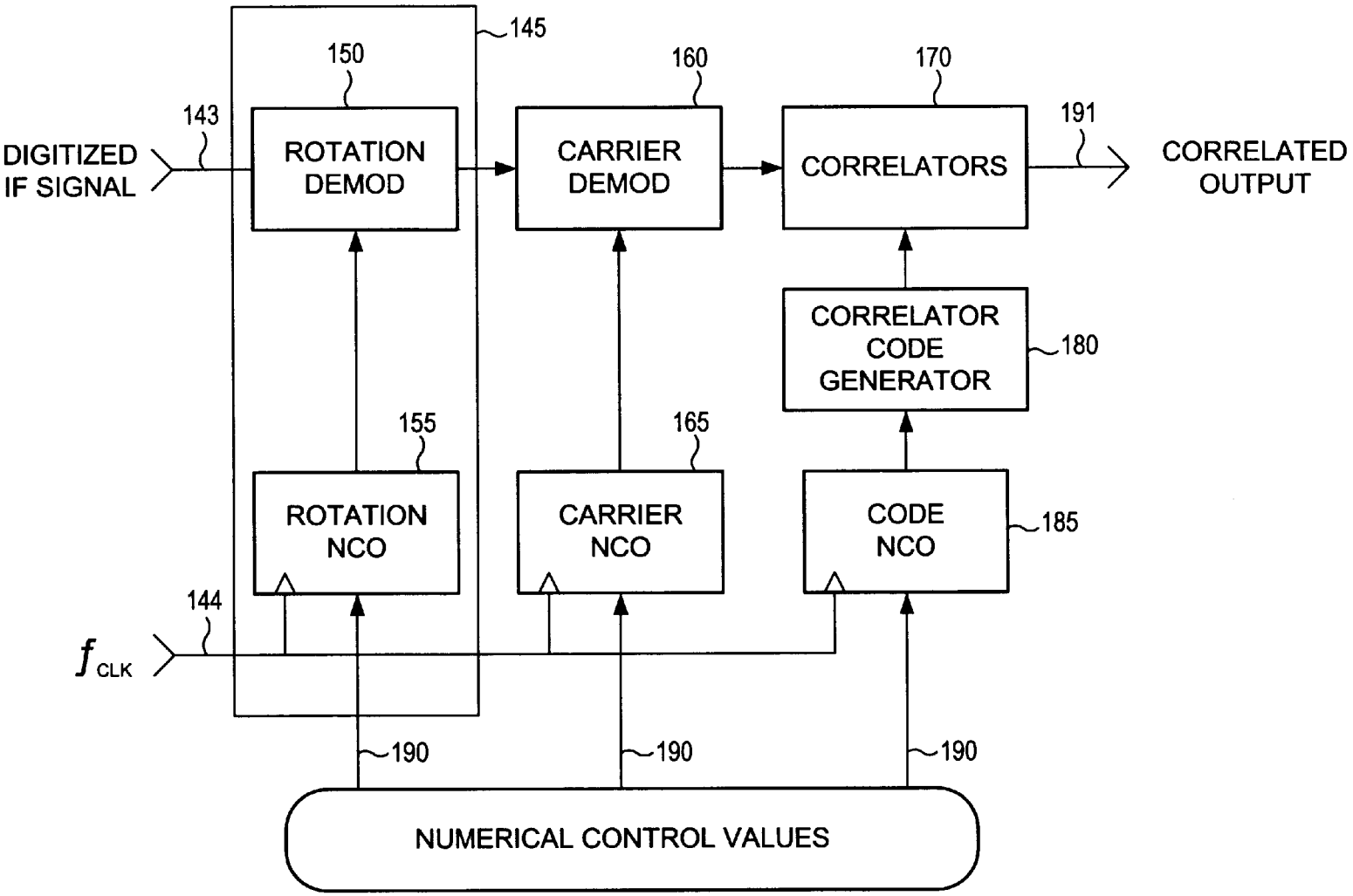
FIG. 6 is a block diagram that depicts the addition of novel rotation demodulation components to a digital signal processing section.

FIG. 6 is a block diagram that depicts the addition of novel rotation demodulation components to a digital signal processing section. Ordinarily, GPS DSP 90 comprises a carrier demodulation component 160 followed immediately by code correlators 170. The output of the correlators 170 comprises position information. In the preferred embodiment, code correlators 170 also resolve the attitude of the spinning vehicle relative to the navigation source. Those skilled in the art will appreciate that the carrier demodulator is driven by a numerically controlled oscillator (NCO) 165. A separate NCO 185 is disposed to drive a correlator code generator 180.

By adding a rotation demodulator 150, GPS DSP 90 is able to remove the rotational artifacts that are imposed on the navigation signal by nature of the rotation of the spinning vehicle. The digitized IF signal 143 received from the RF section 85 is demodulated by the rotational demodulator 150 before it is passed on to the carrier demodulator 160. The rotational demodulator 150 is driven by an independent rotation NCO 155. The numerical control values 190 fed to each of the NCOs, rotation NCO 155, carrier NCO 165 and the correlator NCO 185, are derived by the DSP in order to lock onto those respective elements, i.e. the rotation artifact, the navigation signal carrier and the numerical code sequence riding on the carrier. A common clock 144 is used to drive each NCO.

Locking onto the specific spin rate and position of the vehicle is accomplished by first applying a roll angle estimate ($\theta_{Est}$). If $\theta_{Est}$ is within convergence range of the actual roll angle, then the correlation output of that channel will be maximized. If the rotation estimate driving the rotation demodulator is misaligned with the true rotation angle, the correlation magnitude of that channel will be reduced.

Figure 7:
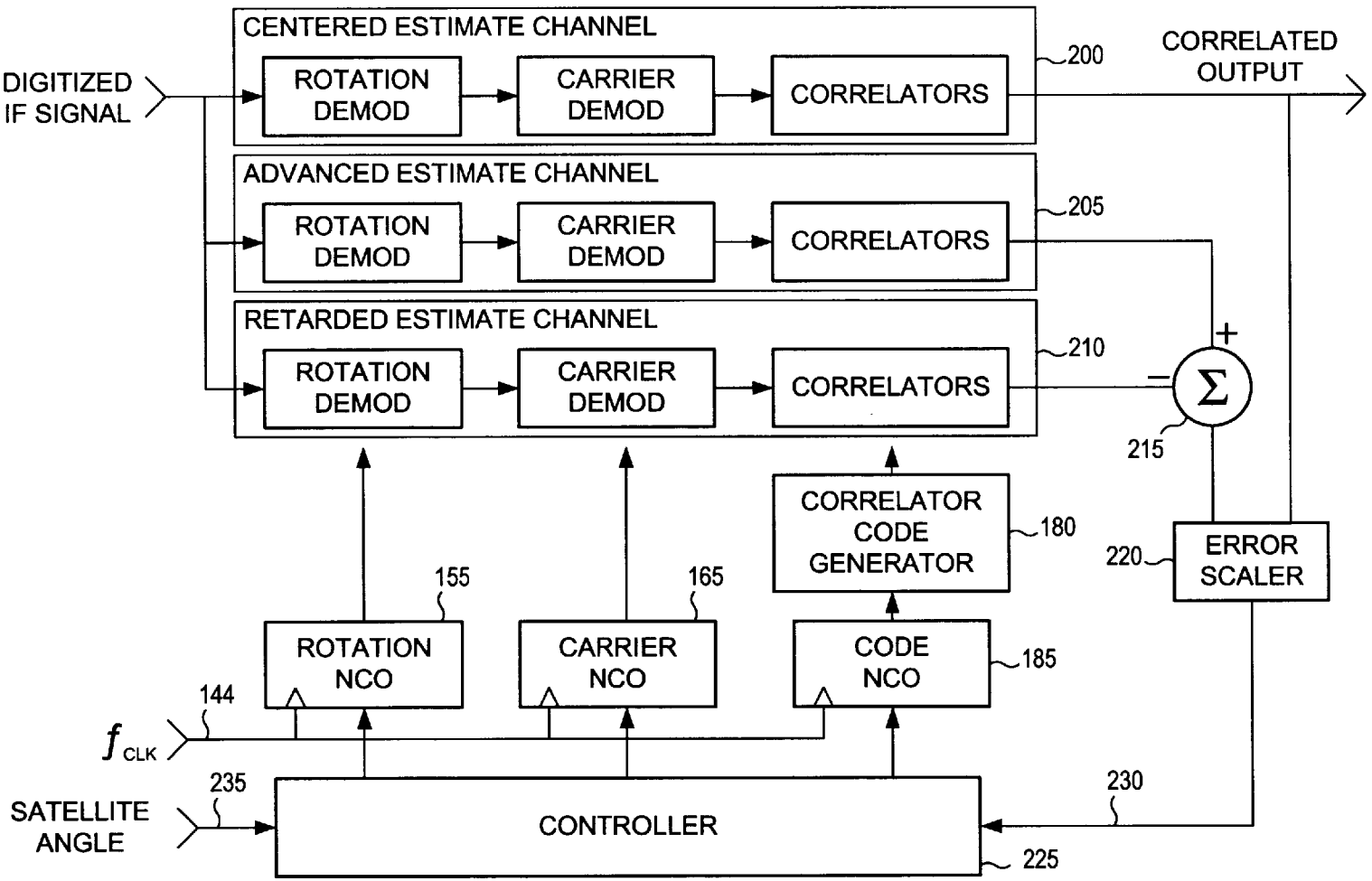
FIG. 7 is a block diagram that depicts the use of three channels to track phase of the spinning vehicle's roll rate.

FIG. 7 is a block diagram that depicts the use of three channels to track phase of the spinning vehicle's roll rate, i.e., the roll angle. To generate a reliable phase angle error signal, two additional channels are utilized in addition to the normal tracking channel. The first additional channel is an advanced estimate channel 205. The advanced estimate channel 205 is driven with an "advanced" estimate of the rotation phase ($\theta=\theta_{Est}+\delta_\theta$). The second additional channel is the retarded estimate channel 210. The retarded estimate channel 210 is driven with a "retarded" estimate of the phase ($\theta=\theta_{Est}-\delta_\theta$). The normal tracking channel is the centered estimate channel ($\theta=\theta_{Est}$). The centered estimate channel provides optimal navigational signal tracking. The roll angle estimate is maintained as an angle relative to local level. The satellite coordinates are utilized to control the rotation demodulation. The rotation demodulation of a channel tracking the $i^{th}$ satellite is, in general, a function of the satellite pitch angle $\phi_i$ and the satellite roll angle $\theta_i$ relative to the antenna. The satellite roll angle relative to the antenna is given by $\theta_{Ant}=\theta-\theta_i$, where $\theta_i$ is the roll angle of the $i^{th}$ satellite relative to the de-spun coordinates of the vehicle. Of course, the use of the term "satellite" is not intended to limit the scope of the present invention to earth-orbiting navigation sources and this same technique is applicable for locking onto earth-bound beacons.

The advanced correlation magnitude (|SA|) and the negative of the retarded correlation magnitude (|SR|) are directed into a summer 215. The output of the summer 215 is directed into an error scaler 220. Error scaler 220 normalizes the difference in the advanced correlation magnitude |SA| and the retarded channel correlation magnitude |SR| by the centered correlation magnitude |SC|, hence the error function can be specified by:

$$ER = \frac{|SA| - |SR|}{|SC|}$$

Those skilled in the art will realize that alternate forms of the error signal may also be utilized. For example, the normalization by the centered correlation magnitude may be eliminated and the squared magnitudes, or alternate forms of signal amplitude measures, may be used to reduce the computational complexity.

The roll error signal ER 230 is used by the rotation angle estimate controller 225 to servo the roll-angle estimate $\theta_{Est}$ to the actual vehicle roll angle. For initial acquisition, the spin-rate frequency may be coarsely estimated by measuring the modulation of the correlation magnitudes with the demodulation frequency set to one or more initial values, or by utilizing accelerometer data.

Rotation angle estimate controller 225 can be implemented using any suitable closed loop feedback function. In the preferred embodiment, rotation angle estimate controller 225 tracks the apparent amplitude modulation of the navigation signal and the apparent phase modulation of the navigation signal to drive a single roll angle estimate. The current implementation of the amplitude demodulation means is embodied as a simple on-off function. The on-off function attenuates the signal level of the digital IF signal when the navigation source falls outside of the antenna's 25 field of view. As the spinning vehicle continues to rotate and the navigation source is again visible to the antenna 25, the on-off function amplifies the digitized IF signal presented to the correlation channels. Phase demodulation is accomplished by applying an integer-clock-delay phase model. Note that in the rotation demodulation function $M(\theta_{Ant}, \phi_{Ant})$, the phase delay is reversed to remove the phase modulation due to rotation. Determination of when the antenna is in the field of view of an antenna is based on the current estimate of roll angle for the spinning vehicle.

In the preferred embodiment, all three correlator channels are driven by a single suite of NCOs. Hence, the rotation NCO 155 drives three rotation demodulators in each of three correlator channels—centered estimate 200, advanced estimate 205 and retarded estimate 210. In like fashion, the carrier NCO 165 drives all three correlator channels. A single code NCO 185 drives a single correlation code generator 180, the output of which is then used to drive each of these three correlator channels as well. A common clock 144 is used to drive all NCOs.

Figure 8:
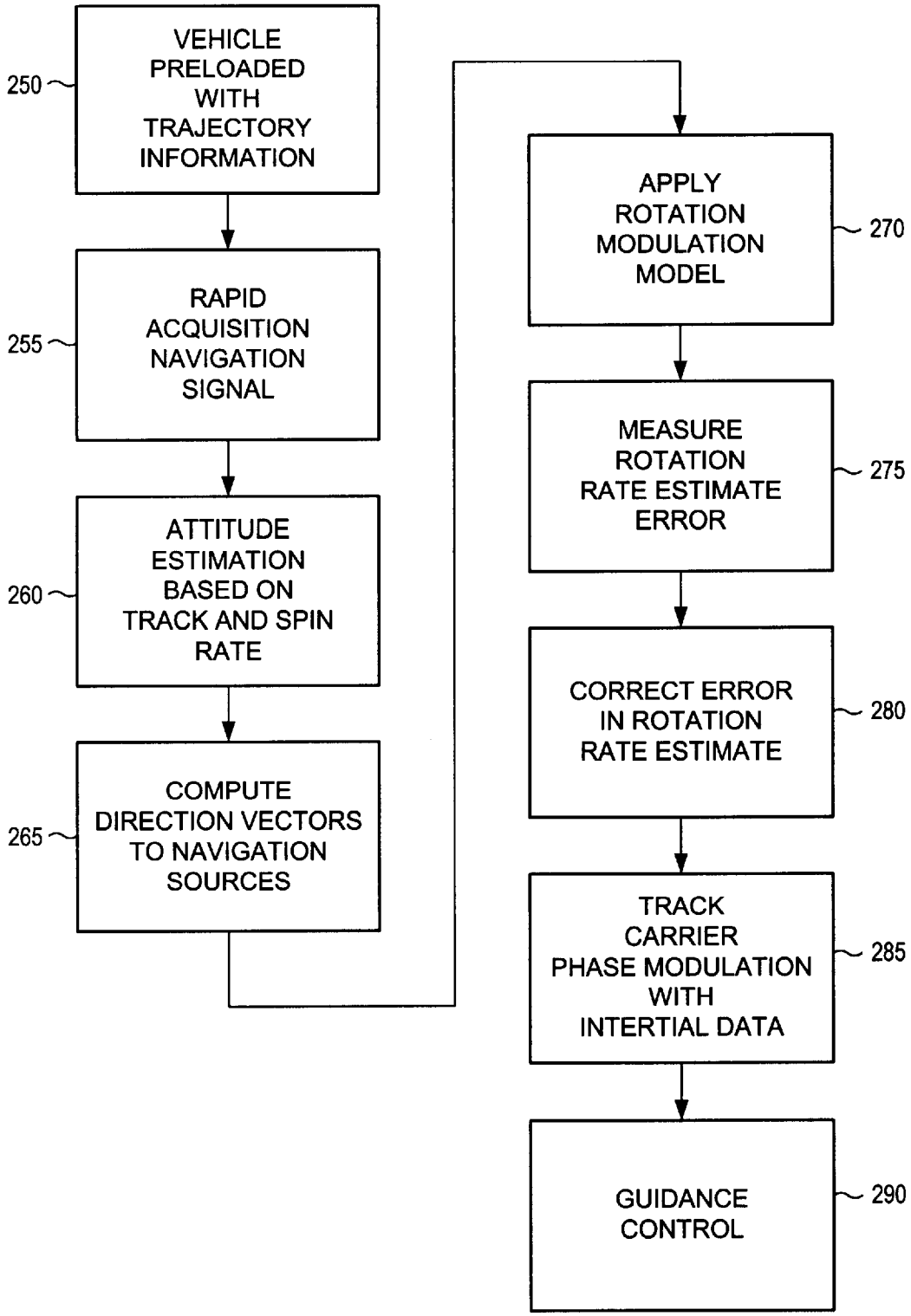
FIG. 8 is a flow diagram that depicts an operational sequence of events that promotes rapid navigational signal acquisition by a spinning vehicle according to the present invention.

FIG. 8 is a flow diagram that depicts an operational sequence of events that promotes rapid navigational signal acquisition by a spinning vehicle according to the present invention. In typical spinning vehicle applications, such as a spinning artillery shell, rapid acquisition of the GPS signals is vital. Tracking the carrier modulation due to rotation adds unknown parameters that could significantly slow the acquisition procedure if all parameters were estimated simultaneously. Fortunately simultaneous acquisition is typically not necessary. Because code-tracking is typically necessary to track the phase of the low-power GPS signals, the first step is traditional code (position) acquisition. If the nominal trajectory of the vehicle is known (as in typical shell applications) satellites more closely aligned along the approximate spin axis may be acquired first. Hence, the first step in an operational sequence comprises pre-loading the spinning vehicle with a probable trajectory (step 250).

After code acquisition (step 255), the attitude of the vehicle can be estimated from the trajectory of the vehicle (step 260). If necessary, a radial accelerometer may be used to obtain a rough estimate of the rotation rate. This is followed by the creation of direction vectors to the navigation source (step 265). The attitude estimate and an approximate rotation rate may then be applied to the rotation demodulator (step 270). If the rotation rate estimate is adequately close to the true rotation rate, the correlation output will be modulated at a frequency equal to the difference between the rotation rate estimate and the true rotation rate (step 275). This modulation may be measured and used to correct the rotation rate frequency estimate (step 280). The phase of the rotation may then be determined by minimizing the difference in the correlation output between two channels with advanced and retarded rotation angle estimates (e.g., $M\phi\ (\theta+\delta_\theta,\phi,\psi)$, $M\phi\ (\theta-\delta_\theta, \phi, \psi)$). Once the phase of the rotation is determined, the rotation modulation may be applied to all channels to improve signal to noise performance of the system. Inertial data, also demodulated to remove rotational artifacts, is used as a further basis for tracking carrier phase modulation (step 285).

The navigational data can be used to steer the vehicle toward the desired destination (step 290). In applications requiring guidance, some type of actuator or control must be provided to steer the vehicle. If the actuator is rotating with the vehicle, the control signals must be modulated to produce a force in the correct direction as the vehicle turns. Many types of actuators may be used, but all must have a control bandwidth to allow modulation at the vehicle's rotation rate.

While this invention has been described in terms of several preferred embodiments, it is contemplated that alternatives, modifications, permutations, and equivalents thereof will become apparent to those skilled in the art upon a reading of the specification and study of the drawings. It is therefore intended that the true spirit and scope of the present invention include all such alternatives, modifications, permutations, and equivalents. Some, but by no means all of the possible alternatives are described herein.

Although the preferred embodiment relies on the use of global positioning satellites as navigation sources, any navigation source can be utilized. Some alternatives include, but are by no means limited to terrestrially deployed navigation beacons and the Russian global navigation satellite system, i.e. GLONASS.

In some applications there may be a need for additional antennas to optimize signal acquisition. Multiple antennas can be used, or the signals from multiple directional antennas could be combined. Signal combination may be performed at the input to the RF section, or multiple RF section outputs may be combined in the GPS DSP. It may be perceived that the use of a demodulated directional antenna would significantly degrade the signal to noise quality of the navigation system. However, this is not the case. A typical antenna utilized in such a system will have significant gain for about one half of a rotation. Once the system "locks on" to the rotation, the navigation signal will only be processed during the period of significant gain. The received noise is also not processed during the period of time when the antenna is not pointed toward the navigation signal source. The signal to noise reduction is proportional to the square root of the reduction in averaging time.

In spinning vehicles, omni-directional antennas are typically utilized. These antennas collect both signal and noise in all directions and are analogous to using two directional antennas electrically combined. Because the signal is typically only received by one element at a time, signal strength is reduced by half, but both antennas continuously receive noise. This implies that the noise level is not reduced. Given a uniform noise background, signal to noise performance of a rapidly spinning antenna (with proper demodulation) is roughly equivalent to an omnidirectional antenna. However, in most applications including, but not limited to GPS guided munitions, the navigation signal originates from a different direction from the majority of noise and jamming sources. This permits the demodulated spinning antenna to have significantly improved performance over omnidirectional antennas.

For a typical directional antenna, there will be a 3 to 5 dB increased rejection for interference signals 90° from the direction of the navigation signal, and a 15 to 20 dB reduction in noise or jamming sources in the direction opposite the navigation signal. Several navigation sources can be tracked simultaneously. This improves the likelihood that at least one navigation source will be in a direction opposite from the noise source. The navigation system may utilize the satellite or terrestrial beacon signals with the best noise rejection in order to aid the tracking of the other navigation signals.

Further improvement in signal to noise performance may be obtained by combining the outputs of multiple RF sections in the rotation demodulator. This technique provides a continuous signal from all satellites as if the channel had a directional antenna continuously steered toward its navigation source. Utilizing multiple antennas is especially useful in applications where vehicle rotation rate may be slow. In this case the added antennas ensure that the navigation signals are uninterrupted regardless of rotation rate.

What is claimed is:

1. A method for determining the rotational orientation of a spinning vehicle comprising the steps of:

receiving a navigation signal at an antenna mounted on a spinning vehicle wherein the navigation signal is generated by a navigation source;

tracking at least one of an apparent amplitude modulation and an apparent phase modulation of the navigation signal as the vehicle spins;

decoding the navigational signal in order to extract position information therefrom;

calculating source vectors that define the direction from the spinning vehicle to the navigation source using the extracted position information; and calculating a rotational position of the spinning vehicle relative to the navigation source as described by the source vectors based on at least one of the apparent amplitude modulation and the apparent phase modulation of the navigation signal.

2. The method of claim 1 wherein the navigation signal received at the antenna is a global positioning system satellite signal.

3. The method of claim 1 wherein the navigation signal received at the antenna is a GNSS satellite signal.

4. The method of claim 1 wherein the navigation signal received at the antenna is generated by a terrestrially-based source.

5. The method of claim 1 further comprising the step of calculating a navigational trajectory for the spinning vehicle based on a successive samples of position information extracted from the navigational signal.

6. The method of claim 5 further comprising the steps of:

receiving inertial data from an inertial sensor;

demodulating the inertial data to remove rotational artifacts;

calculating a projected trajectory of the spinning vehicle based on successive samples of the demodulated inertial data; and conforming the navigational trajectory of the spinning vehicle to the projected trajectory when the projected trajectory differs from the navigational trajectory.

7. The method of claim 1 wherein the step of receiving a navigation signal comprises the steps of:

receiving a radio frequency signal from the navigation source;

converting the radio frequency signal to a lower intermediate frequency signal;

digitizing the intermediate frequency signal into a stream of digital values; and removing rotation artifacts from the stream of digital values based on an estimate of a rotation rate and an estimate of an attitude of the spinning vehicle relative to the navigation source by at least one of (a) amplifying the magnitude of the received stream of digital values when the navigation source is in the view of the antenna and attenuating the received stream of digital values when the navigation source is outside the view of the antenna, and (b) correcting the apparent phase modulation due to rotation.

8. An apparatus for determining the trajectory and orientation of a spinning vehicle comprising:

an antenna for capturing radio signals wherein said antenna is mounted on a spinning vehicle;

a receiver that accepts radio signals from the antenna and selects a navigation signal from amongst the radio signals wherein said navigation signal is generated by a navigation source;

a tracking unit that tracks at least one of an apparent amplitude modulation and an apparent phase modulation of the navigation signal accepted from the receiver;

a decoding unit that accepts the navigation signal and extracts position information therefrom and provides successive samples of position information;

a modulation geometry processor that accepts successive samples of position information from the decoding unit and creates and then provides source vectors that are indicative of the direction from which the navigation signal was received relative to the spinning vehicle;

an attitude estimator that accepts source vectors from the modulation geometry processor and calculates the rotational position of the spinning vehicle relative to the navigation source based on at least one of the apparent amplitude modulation and the apparent phase modulation of the navigation signal; and a position estimator that accepts a sample of extracted position information from the decoding unit and a source vector from the modulation geometry processor and determines the position of the spinning vehicle relative to the navigation source.

9. The apparatus of claim 8 wherein the receiver selects navigation signals generated by a global positioning system satellite.

10. The apparatus of claim 8 wherein the receiver selects navigation signals generated by a GNSS satellite.

11. The apparatus of claim 8 wherein the receiver selects navigation signals generated by a terrestrial navigation source.

12. The apparatus of claim 8 further comprising a guidance processor that accepts successive samples of position information from the position estimator and creates a navigational trajectory.

13. The apparatus of claim 12 further comprising:

an inertial sensor demodulator that accepts a signal from an inertial sensor, removes rotational artifacts from the signal and creates a demodulated inertial signal and wherein the position estimator further comprises an anticipation unit that:

receives the demodulated inertial signal;

calculates a projected trajectory based on that signal;

compares the navigational trajectory with the projected trajectory; and conforms the navigational trajectory to the projected trajectory.

14. The apparatus of claim 8 wherein the receiver comprises:

a radio frequency section that converts radio frequency signals into intermediate frequency signals;

a digitizer that accepts the intermediate frequency signals and converts these intermediate frequency signals into a stream of digital values; and a signal processor that accepts the stream of digital values and removes rotation artifacts from the stream based on estimates of rotation and attitude of the spinning vehicle relative to the navigation source wherein the estimates of rotation and attitude are stored in a rotation estimate register and an attitude estimate register.

15. The apparatus of claim 14 wherein the signal processor updates the estimates of rotation rate and attitude by amplifying the magnitude of the received stream of digital values when the navigation source is believed to be in view of the antenna and attenuating the magnitude of the received stream of digital values when the navigation source is believed to be outside the view of the antenna and then examining the signal quality of the signal wherein the belief of when the navigation source is in view of the antenna is derived from the estimate of rotation attitude.

16. The apparatus of claim 14 wherein the tracking unit comprises:

a first offset processing unit for processing a advanced estimate of attitude in order to generate a advancement signal;

a second offset processing unit for processing a retarded estimate of attitude in order to generate a retardation signal;

a differencing unit that subtracts the advancement signal from the retardation signal and creates a magnitude difference signal that reflects the difference between the magnitude of the advancement and the magnitude of the retardation signals; and an estimate update unit that updates the value of rotation and attitude estimates stored in the rotation estimate register and the attitude estimate register based on the magnitude difference signal.

17. The apparatus of claim 14 wherein the signal processor delays the propagation of the stream of digital values in accordance with an estimate of the rotational position of the spinning vehicle relative to the navigation source.

18. A system for guiding a spinning vehicle to a destination comprising:

a navigation source that generates a navigation signal;

a spinning vehicle that determines position and attitude as a function of at least one of the apparent amplitude modulation and apparent phase modulation; and a spinning vehicle launcher that deploys the spinning vehicle toward a destination.

19. The system of claim 18 wherein the navigation source is an earth-orbiting satellite.

20. The system of claim 19 wherein the earth-orbiting satellite is a global positioning system satellite.

21. The system of claim 19 wherein the earth-orbiting satellite is a GNSS satellite.

22. The system of claim 18 wherein the navigation source is terrestrially based.

23. The system of claim 18 wherein the spinning vehicle launcher loads probable trajectory information into the spinning vehicle prior to deployment.

24. The system of claim 23 wherein the spinning vehicle uses the probable trajectory information as a basis for a rapid acquisition of navigation sources.

* * * * *